US012151720B1

(12) United States Patent
Huang et al.

(10) Patent No.: US 12,151,720 B1
(45) Date of Patent: Nov. 26, 2024

(54) ANTI-COLLISION BUFFERING DEVICE FOR HIGH-SPEED TRAIN

(71) Applicant: TAIYUAN UNIVERSITY OF TECHNOLOGY, Taiyuan (CN)

(72) Inventors: Qingxue Huang, Taiyuan (CN); Xiaoqiong Zhang, Taiyuan (CN); Tao Wang, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 0 days.

(21) Appl. No.: 18/799,973

(22) Filed: Aug. 9, 2024

(51) Int. Cl.
*B61G 11/16* (2006.01)
*B61G 11/12* (2006.01)
*B61G 11/18* (2006.01)

(52) U.S. Cl.
CPC ..... *B61G 11/16* (2013.01); *B61G 11/12* (2013.01); *B61G 11/18* (2013.01)

(58) Field of Classification Search
CPC ..... B61G 11/12; B61G 11/16; B61G 11/18
See application file for complete search history.

(56) References Cited

U.S. PATENT DOCUMENTS

2020/0231191 A1* 7/2020 Sunde ..... B61G 11/18
2021/0394803 A1* 12/2021 Font ..... B61D 19/023

FOREIGN PATENT DOCUMENTS

| | | | | |
|---|---|---|---|---|
| CN | 101125539 A | | 2/2008 | |
| CN | 103661182 A | | 3/2014 | |
| CN | 203558027 U | | 4/2014 | |
| CN | 109050569 A | * | 12/2018 | ..... B61G 11/12 |
| CN | 109131417 A | * | 1/2019 | ..... B61G 11/18 |
| CN | 115489562 A | * | 12/2022 | ..... B61G 11/18 |
| CN | 116534071 A | | 8/2023 | |
| EP | 3981666 A1 | * | 4/2022 | ..... B61F 19/04 |

OTHER PUBLICATIONS

Huang Rui et al., "Study on Energy Absorption Properties of Thin-walled Circular Tubes Filled with Aluminum Foam under Axial Compression", Journal of Taiyuan University of Technology, Issue 1, Jan. 31, 2016, pp. 101-107.

* cited by examiner

*Primary Examiner* — Robert J McCarry, Jr.

(57) ABSTRACT

An anti-collision buffering device for high-speed train is provided. The anti-collision buffering device for high-speed train includes: an impacting and buffering body, which is hollow to form a buffering cavity filled with buffering medium; a contacting pad is arranged at a front end of the impacting and buffering body, contacting beams are arranged at a rear end of the impacting and buffering body, one or more impacting and buffering bodies are arranged between two adjacent carriages of the high speed train, the buffering cavity is divided into three sub-cavities by separating plates, an inner buffering cavity at a middle and two outer buffering cavities at sides, an protruding cavity is arranged on the inner buffering cavity. The anti-collision buffering device for high-speed train has simple structure, relatively low manufacturing cost, and is feasible for practical production, and with practical significance.

9 Claims, 3 Drawing Sheets

ANTI-COLLISION BUFFERING DEVICE FOR HIGH-SPEED TRAIN

CROSS REFERENCE TO RELATED APPLICATIONS

This application claims foreign priority of Chinese Patent Application No. 202410450989.X, filed on Apr. 16, 2024 in the China National Intellectual Property Administration, the disclosures of all of which are hereby incorporated by reference.

TECHNICAL FIELD

The present disclosure relates to the technical field of rail transit safety protection, in particular to an anti-collision buffering device for high-speed train.

BACKGROUND

In recent years, with the advancement of science and technology and the requirements of transportation timeliness, a high-speed train is rapidly developed in China and even worldwide. High density arrangement of high-speed rail, bullet train, urban rail, subway and the like, and the increasing speed limit of the high-speed train, bringing huge challenge to prevention and control protection of rail transit safety.

In potential safety hazards of many high-speed rail transit, accidents caused by impact collision all occupy a high proportion all the time, in the past five years, 50% of all rail traffic accidents are occupied, and impact collision safety protection of rail transit of a high-speed train is always a hot topic developed by a rail transit technology. The high-speed rail with the fastest running speed is taken as an example (the test speed can reach 486 km/h). In order to pursue higher speed, the existing high-speed train adopts a construction mode that 8 sections of carriages are tightly connected. Higher driving speed is achieved, higher impact kinetic energy is brought, and more strict requirements are brought to impact collision avoidance. In past impact anti-collision researches, due to tight connection between carriages, the anti-collision buffer space is limited, impact collision avoidance mostly depends on an anti-creeping buffering device in front of the driving compartment and a rigid hook buffering device with a simple buffer box at the bottom of the compartment, and at present, the devices are more mature and applied to actual production of the high-speed train.

However, the buffer space of the device is limited, the energy absorption protection mechanism is that the rigid long rod extends to impact the compressible structure material, considering that the rigid long rod is prone to instability and break in the impact process, the extension is limited, compression of subsequent structural materials is affected, the energy absorption tolerance (far lower than a theoretical tolerance) is reduced. The energy absorption requirement of the high-speed train at the present stage is insufficient. The impact of buffering device is updated based on a more advanced, reasonable and actual buffer principle with higher energy absorption capacity limit in the future high-speed train vehicle structure design in the future high-speed train vehicle structure design, and has great research and practical significance.

SUMMARY

The purpose of the present disclosure is to overcome the shortcomings in the prior arts, the present disclosure provides an anti-collision buffering device for high-speed train, having characteristics of split cavity expansion, stretching, and deformation, and energy absorption. The anti-collision buffering device for high-speed train changes the tradition way in anti-collision and energy absorption of the rigid long rod extension impacts compressible structural materials, to avoid the defect of insufficient buffering and energy absorption capacity caused by actual structural impact instability.

To realize the above objectives, the present disclosure provides a an anti-collision buffering device for high-speed train, including: an impacting and buffering body, wherein the impacting and buffering body is hollow to form a buffering cavity, and the buffering cavity is filled with buffering medium; and a contacting pad is arranged at a front end of the impacting and buffering body, wherein the contacting pad is made of a whole steel plate, and the contacting pad is configured to fixedly connect with a front compartment tail plate of a high-speed train; and contacting beams are arranged at a rear end of the impacting and buffering body, wherein the contact beams are arranged in pairs and are symmetrical to a center line of the impacting and buffering body, and the contact beams are configured to fixedly connect with a rear compartment tail plate of the high-speed train; and one or more impacting and buffering bodies are arranged between two adjacent carriages of the high speed train, and are symmetrically arranged along a width center line of the carriage; the buffering cavity is divided into three sub-cavities by separating plates, an inner buffering cavity at a middle and two outer buffering cavities at sides, wherein the two outer buffering cavities are located on a left side and a right side of the inner buffering cavity respectively, and the inner buffering cavity is communicated with the two outer buffering cavities through communication hole; and an protruding cavity is arranged on the inner buffering cavity, wherein the protruding cavity is convex upwards at a top of the inner buffering cavity, and the protruding cavity are completely communicated with the inner buffering cavity.

Furthermore, a one-way valve is arranged in the communication hole between the inner buffering cavity and the outer buffering cavity.

Furthermore, a thickness of the contacting pad is 15 mm to 25 mm.

Furthermore, a top of the contacting beam is designed in an arc-shaped structure, and a distance of a top width is less than that of a bottom width.

Furthermore, the impacting and buffering body has a flat structure with a height between 150 mm to 250 mm, and a length and a width of the impacting and buffering body are both greater than a height of the impacting and buffering body.

Furthermore, wherein the inner buffering cavity is filled with paraffin and paraffin oil in a solid-liquid mixed state.

Furthermore, wherein the separating plates is provided with rounded corners, and connecting portions of the separating plates and an inner wall of the buffering cavity are processed by locally increasing a wall thickness.

Furthermore, an outer surface of the impacting and buffering body is coated with a polyurea coating.

Furthermore, wherein a distance between two adjacent contact beams is 140 mm to 180 mm.

Mechanism of action of the present disclosure: the contacting pad is connected to the front compartment tail plate of the high-speed train, and when impacted, the contacting pad can undergo bending and stretching deformation with a certain amplitude, and further squeeze the impacting and buffering body to transfer the impact energy to the impacting and buffering body, so that the buffering medium in the impacting and buffering body flows downwards and outwards to drive the cavity wall to bend and deform, so that the whole cavity structure is expanded, and more impact energy can be buffered and absorbed under the overall expansion and stretching effect. The effect of the contacting beam is that after impact collision occurs, constrained by the contacting beam, the rear wall of the impacting and buffering body can be divided into three parts for expansion deformation, and the energy absorption buffer tolerance of the core device for impacting the expansion buffering cavity is increased.

When the impacting and buffering body is impacted, the change in the impacting and buffering body is that the height of the protruding cavity is 50 mm to 70 mm, the top surface of the impacting and buffering body is in direct contact with the contacting pad and is preliminarily extruded by the contacting pad, and the cavity wall of the protruding cavity can be deformed by bending under bending, and the space in the impacting and buffering body and the buffering medium are extruded. The inner buffering cavity is communicated with the protruding cavity, a lateral dimension is 200 mm, inner buffering cavity is filled with paraffin and paraffin oil in solid-liquid mixed state; after the protruding cavity is extruded and deformed, the space of the inner buffering cavity is extruded downwards, then the buffering medium in the inner buffering cavity flows towards the outer side, and then the inner buffering cavity swells to absorb the buffer impact energy. When the inner buffering cavity deforms and expands to the internal pressure to reach the threshold, the one-way valve on the communication hole on the separating plate is opened, and the buffering medium enters the outer buffering cavity from the communication hole. In the outer buffering cavity, as the buffering medium flows in and impacts, the outer buffering cavity is further squeezed to drive the outer buffering cavity to expand, so as to further absorb the buffer impact energy.

For the solid-liquid mixed paraffin and paraffin that preset in the inner buffering cavity, when the high-speed train runs normally, the solid paraffin can prevent the leakage of the buffering medium in the cavity to a certain extent, and after the impact occurs, the instantaneous high-speed impact can generate large heat, and the collision heat generation will further convert the solid paraffin into liquid paraffin oil for oil pressure to drive the cavity to expand and deform to absorb energy.

The beneficial effects of the present disclosure: changing the anti-collision energy absorption and buffering principle of the traditional high-speed train anti-collision buffer relying on the rigid long rod extending to impact the compressible structural material, and using the oil pressure to drive the overall structural expansion tensile deformation buffer energy absorption of the oil pressure driving of the overall structure, thereby avoiding the defect of insufficient buffer energy absorption tolerance caused by actual structural impact instability. The traditional energy absorption device mainly utilizes local buckling and shaping deformation, the material deformation is insufficient, the utilization rate is not high, and the energy absorption performance of the present disclosure can be improved exponentially through the global tensile deformation energy absorption.

LABELS AND DESCRIPTION

100 anti-collision buffering device for high-speed train, 1 contacting pad, 2 impacting and buffering body, 20 buffering cavity, 21 separating plate, 22 inner buffering cavity, 23 outer buffering cavity, 24 communication hole, 25 one-way valve, 26 protruding cavity, 3 contacting beam, 4 rear compartment tail plate.

DETAILED DESCRIPTION OF THE EMBODIMENTS

The technical solutions in the embodiments of the present disclosure will be described clearly and completely with reference to the accompanying drawings in the embodiments of the present disclosure. Obviously, the described embodiments are only a part of the embodiments of the present disclosure rather than all of them. Based on the embodiments in the present disclosure, all other embodiments obtained by those skilled in the art without creative work shall fall within the scope of protection of the present disclosure.

Figure 1:
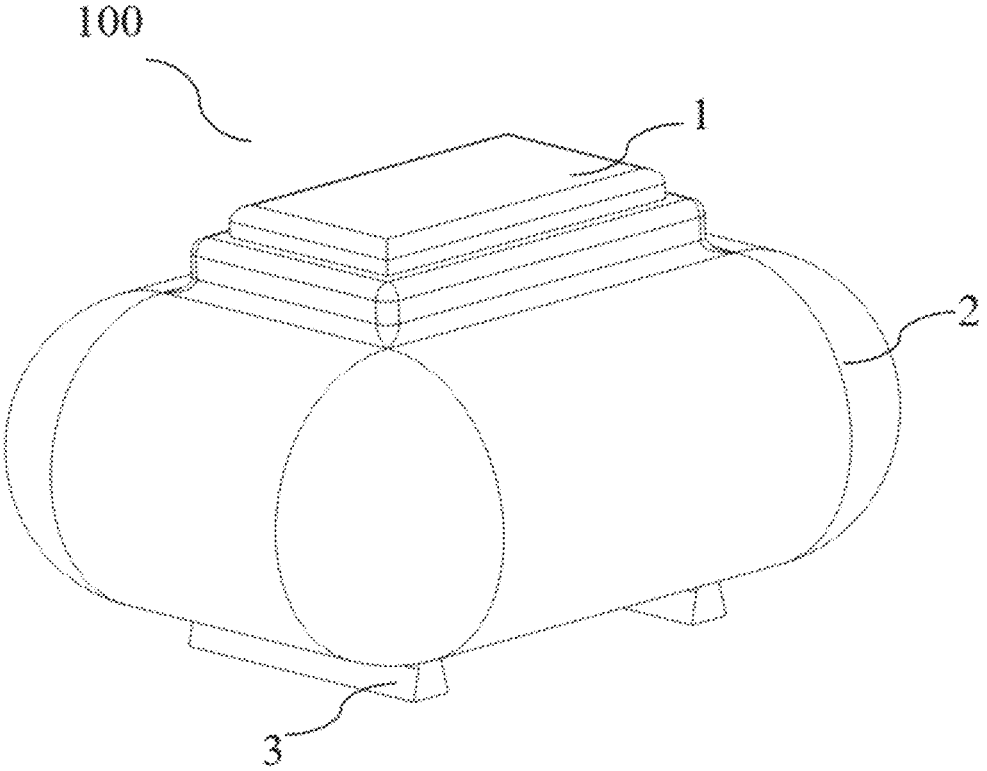
FIG. 1 is an external schematic structural diagram of an anti-collision buffering device for high-speed train according to an embodiment of the present disclosure.

Please refers to the FIG. 1, this embodiment provides an anti-collision buffering device for high-speed train 100, which has characteristics of split cavity expansion, stretching, deformation, and energy absorption. A length of the anti-collision buffering device for high-speed train 100 is 400 mm, width is 300 mm and the height is 180 mm, and an overall shape is flat. A contacting pad 1 is made of ASI340 stainless steel, and a thickness is 20 mm, and a tensile strength is 500 MPa. The contacting pad 1 is disposed at a foremost end of anti-collision buffering device for high-speed train 100, which is fixedly connected to the front compartment tail plate of the high-speed train. In order to prevent the top wall of the impacting and buffering body 2 from being damaged after the contacting pad 1 is excessively extruded in the impact process, the edge of the contacting pad 1 is subjected to rounded corner processing, and the thicker contacting pad 1 can resist piercing of the impact debris while bearing and buffering a higher impact force, thereby avoiding affecting the impacting and buffering body 2.

The impacting and buffering body 2 has a height of 150 mm, which is located between the contacting pad 1 and the contact beam 3. The impacting and buffering body 2 is a main component that consumes impact force. And the impacting and buffering body 2 is close to a rear side of the contacting pad 1. An interior of the impacting and buffering body 2 is divided into three sub-cavities by separating plates 21: an inner buffering cavity 22 at a middle and two outer buffering cavities 23 at sides, the two outer buffering cavities 23 are located on a left side and a right side of the inner buffering cavity 22 respectively One or more communication holes 24 are provided on the separating plates 21, and each communication hole 24 is matched with an one-way valve 25, so that the buffering medium can flow into the outer buffering cavity 23 from the inner buffering cavity 22. A side wall of the impacting and buffering body 2 and the separating plate 21 are made of 10 mm X80 pipeline steel, have good bending deformation capability, and have a tensile strength of about 1000 MPa.

Generally, there are two contact beams 3, which are arranged at a bottom of the impacting and buffering body 2, and are fixedly and symmetrically connected to the rear compartment by welding or the like, so as to fix the whole anti-collision buffering device for high-speed train 100. After the impact collision occurs, the rear wall of the impacting and buffering body 2 is separated into three parts by the two connecting beams for expansion deformation under the restriction effect of the positions of the two contact beams 3, so that the expandable surface area is increased, and the energy absorption buffer tolerance of the impacting and buffering body 2 of the core anti-collision buffering device for high-speed train 100 can be increased. A top of the contact beam 3 is of an arc-shaped structure, and the distance of the top width is less than the distance of the bottom width, and the structure is similar to a trapezoid. The distance between the two contacting beams is 150 mm, which is about 15 times the thickness of the wall plate of the inner buffering cavity 22, and the distance between the two contacting beams is set to correspond to the deformation characteristics of the three-point bending span-thickness ratio deformation characteristics of the plate, so that the wall plate can be kept stretched, bent and deformed as much as possible under oil pressure expansion without premature fracture damage.

Figure 2:
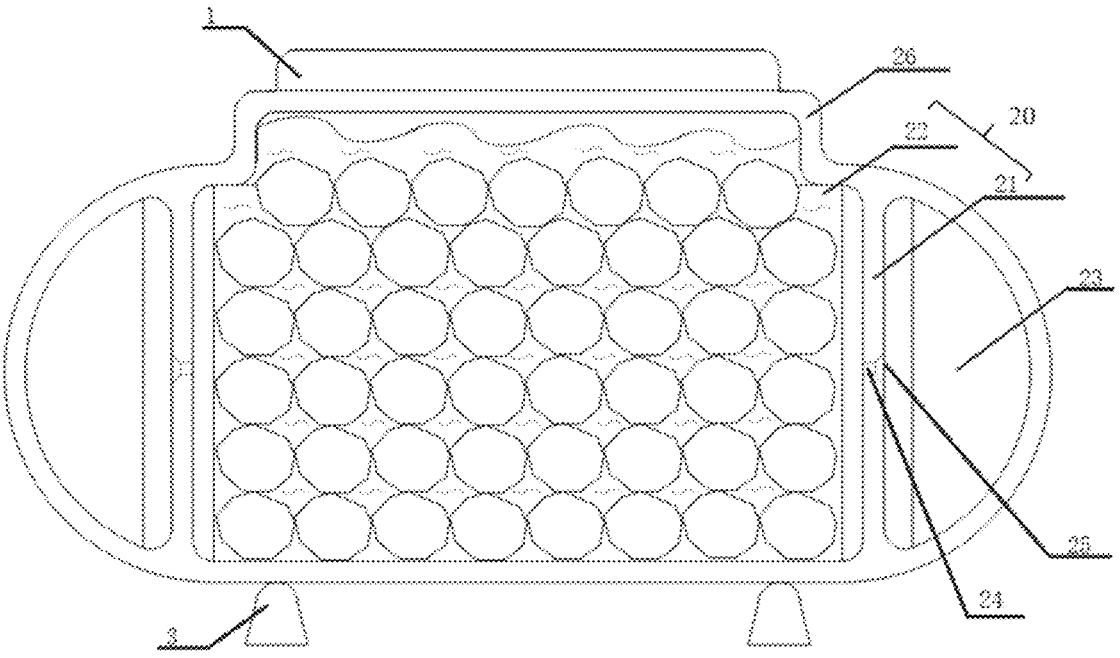
FIG. 2 is an internal schematic structural diagram of an anti-collision buffering device for high-speed train according to an embodiment of the present disclosure.

As shown in FIG. 2, the anti-collision buffering device for high-speed train 100 includes an impacting and buffering body 2, wherein the impacting and buffering body 2 is hollow to form a buffering cavity, and the buffering cavity is filled with buffering medium; a contacting pad 1 is arranged at the front end of the impacting and buffering body 2, the contacting pad 1 is made of a whole steel plate, and the contacting pad 1 is fixedly connected with front compartment tail plate of a high-speed train; contact beams 3 are arranged at the rear end of the impacting and buffering body 2, the contact beams 3 are arranged in pairs and are symmetrical to the center line of the impacting and buffering body 2, and the contact beam 3 are fixedly connected with a rear compartment tail plate 4 of the high-speed train; one or more anti-collision buffers are arranged between two adjacent carriages, and are symmetrically arranged along a width center line of the carriage.

The buffering cavity is divided into three sub-cavities by separating plates 21, an inner buffering cavity 22 at a middle and two outer buffering cavities 23 at sides, wherein the two outer buffering cavities 23 are located on a left side and a right side of the inner buffering cavity 22 respectively, and the inner buffering cavity 22 is communicated with the two outer buffering cavities 23 through communication hole 24. And an protruding cavity 26 is arranged on the inner buffering cavity 22, wherein the protruding cavity 26 is convex upwards at a top of the inner buffering cavity 22, and the protruding cavity 26 are completely communicated with the inner buffering cavity 22. A one-way valve 25 is arranged in the communication hole 24 between the inner buffering cavity 22 and the outer buffering cavity 23. A number of the communication hole 24 can be one or more, and the difference lies in that the speed of the paraffin oil entering the outer buffering cavity 23 from the inner buffering cavity 22 is different.

Figure 3:
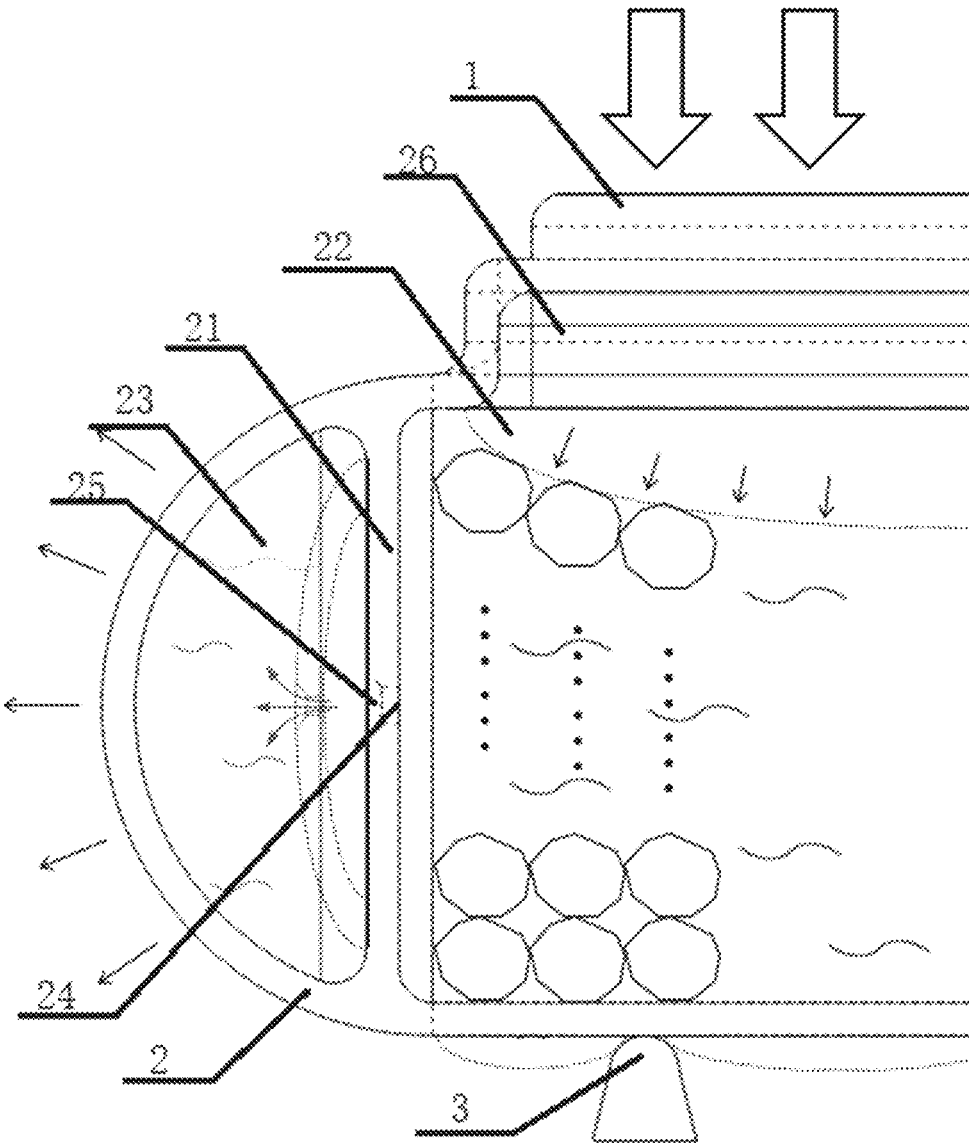
FIG. 3 is a partial schematic structural diagram of an anti-collision buffering device for high-speed train according to an embodiment of the present disclosure.

As shown in FIG. 3, when the impacting and buffering body 2 is impacted, the protruding cavity 26 at the top of the impacting and buffering body 2 is deformed first and extruded downwards, the buffering medium of the inner buffering cavity 22 is squeezed to move towards two sides, the separating plate 21 is extruded. When the pressure is sufficient, the buffering medium enters the outer buffering cavity 23 from the communication hole 24, the buffering medium in the outer buffering cavity 23 continues to extrude the side wall of the outer buffering cavity 23, and the side wall is stressed to continue to deform and absorb energy.

Considering the phenomena of stress concentration and weakness links in the cavity structure in the process of extrusion deformation and impact expansion of the inner cavities of the impacting and buffering body 2, the separating plates 21 is provided with rounded corners, and connecting portions of the separating plates 21 and a wall thickness of an inner wall of the buffering cavity are locally increased.

The outer surface of the impacting and buffering body 2 is coated with a polyurea coating, and the polyurea coating can also avoid accidental damage to the impacting and buffering body 2 caused by debris splashing during vehicle operation and impact while increasing the overall strength and toughness to ensure expansion deformation.

In the present invention, the impact energy is converted into heat energy, kinetic energy and elastic potential energy, and compared with a direct rigid connection buffer mode, the conversion mode of the impact energy is more diversified, and through multi-stage conversion, buffer absorption of large impact energy in a small space can be achieved. When the impacting and buffering body 2 is impacted, the impacting and buffering body 2 is impacted by impact force, and then the top wall of the impacting and buffering body 2 is impacted and bent downwards to deform, and the impact energy is converted into a first elastic potential energy; and then the protruding cavity 26 is pressed downwards, the remaining impact energy is converted into a heat energy; and the solid paraffin in the inner buffering cavity 22 is converted into liquid paraffin oil; the liquid paraffin oil moves downwards to extrude the partition wallboard to deform, and the impact energy is converted into a heat energy and a second elastic potential energy; when the pressure in the inner buffering cavity 22 reaches a threshold value, the paraffin oil extrudes the one-way valve 25 from the communication hole 24 to enter the outer buffering cavity 23, the residual impact energy is converted into kinetic energy and elastic potential energy, the paraffin oil entering the outer buffering cavity 23 can further extrude the outer wall of the outer buffering cavity 23, so that the outer wall of the outer buffering cavity 23 further deforms, and the impact energy is converted into elastic potential energy. Through the transition of the kinetic energy, the thermal energy and the elastic potential energy, the impact energy is gradually attenuated.

The action principle of the present invention is that the contact pad is connected to the front compartment tail plate, and when impacted, the contact pad can undergo bending and stretching deformation with a certain amplitude and squeeze the impacting and buffering body 2 to transfer the impact energy to the impacting and buffering body 2, the medium in the impacting and buffering body 2 flows downwards and outwards to drive the cavity wall to bend and deform, so that the whole cavity structure is expanded, and more impact energy can be buffered and absorbed under the overall expansion and stretching effect. The effect of the contact beam 3 is that after the impact collision occurs, the impacting and buffering body 2 can be divided into three parts for expansion deformation under the restriction effect of the contact beam 3, and the energy absorption buffer tolerance of the impact expansion buffering cavity of the core device is increased.

When the impacting and buffering body 2 is impacted, the change in the impacting and buffering body 2 is that the height of the protruding cavity 26 is 50 mm to 70 mm, the top surface of the impacting and buffering body 2 is in direct contact with the contacting pad 1 and is preliminarily extruded by the contacting pad 1, and the cavity wall of the protruding cavity 26 can be deformed by bending under bending, and the space in the impacting and buffering body 2 and the buffering medium are extruded. The inner buffering cavity 22 is in spatial communication with the protruding cavity 26, the transverse size is 200 mm, paraffin and paraffin oil in a solid-liquid mixed state are placed in the cavity, after the protruding cavity 26 is extruded and deformed, the space of the inner buffering cavity 22 is pressed downwards, then the buffering medium in the inner buffering cavity 22 flows towards the outer side, and then the inner buffering cavity 22 swells to absorb the buffer impact energy. When the inner buffering cavity 22 deforms and expands to the internal pressure to reach the threshold, the one-way valve 25 on the communication hole 24 on the separating plate 21 is opened, and the buffering medium enters the outer buffering cavity 23 from the communication hole 24. In the outer buffering cavity 23, as the buffering medium flows in and impacts, the outer buffering cavity 23 is further squeezed to drive the outer buffering cavity 23 to expand, so as to further absorb the buffer impact energy.

The liquid paraffin oil is filled in the gap of the solid paraffin oil for the paraffin and paraffin oil in the solid-liquid mixed state preset in the inner buffering cavity 22. When the train runs normally, the solid paraffin can prevent the leakage of the medium in the cavity to a certain extent, and after the impact occurs, the instantaneous high-speed impact can generate large heat, and the collision heat generation will further convert the solid paraffin into liquid paraffin oil for oil pressure to drive the cavity to expand and deform to absorb energy. Obviously, all the solid paraffin can be filled or completely filled with liquid paraffin oil.

It should be noted that, due to the non-recoverable deformation and the one-way valve 25 arranged between the inner buffering cavity 22 and the outer buffering cavity 23, the paraffin oil entering the outer buffering cavity 23 does not return into the inner buffering cavity 22, and therefore, the device has a service life. After a certain number of times, the replacement needs to be performed. The specific usage times are different according to different traveling routes and driving mileage of the train, but the device is simple in structure and low in manufacturing cost, and does not increase the driving cost of the train.

The number of buffers arranged between the front carriage and the rear carriage needs to be symmetrically arranged with the center line of the width of the carriage, and when the singular is set, one buffer is placed in the middle of the width of the carriage; and when the number of the buffers is set, the symmetrical arrangement can be achieved. The setting method is also applicable to the setting of different numbers of contact beams 3 at the bottom of the impacting and buffering body 2.

Mechanism of action of the present disclosure: the contacting pad 1 is connected to the front compartment tail plate of the high-speed train, and when impacted, the contacting pad 1 can undergo bending and stretching deformation with a certain amplitude, and further squeeze the impacting and buffering body 2 to transfer the impact energy to the impacting and buffering body 2, so that the buffering medium in the impacting and buffering body 2 flows downwards and outwards to drive the cavity wall to bend and deform, so that the whole cavity structure is expanded, and more impact energy can be buffered and absorbed under the overall expansion and stretching effect. The effect of the contacting beam 3 is that after impact collision occurs, constrained by the contacting beam 3, the rear wall of the impacting and buffering body 2 can be divided into three parts for expansion deformation, and the energy absorption buffer tolerance of the core device for impacting the expansion buffering cavity is increased.

When the impacting and buffering body 2 is impacted, the change in the impacting and buffering body 2 is that the height of the protruding cavity 26 is 50 mm to 70 mm, the top surface of the impacting and buffering body 2 is in direct contact with the contacting pad and is preliminarily extruded by the contacting pad 3, and the cavity wall of the protruding cavity 26 can be deformed by bending under bending, and the space in the impacting and buffering body 2 and the buffering medium are extruded. The inner buffering cavity 22 is communicated with the protruding cavity 26, a lateral dimension is 200 mm, inner buffering cavity 22 is filled with paraffin and paraffin oil in solid-liquid mixed state; after the protruding cavity 26 is extruded and deformed, the space of the inner buffering cavity 22 is extruded downwards, then the buffering medium in the inner buffering cavity 22 flows towards the outer side, and then the inner buffering cavity 22 swells to absorb the buffer impact energy. When the inner buffering cavity 22 deforms and expands to the internal pressure to reach the threshold, the one-way valve 25 on the communication hole 24 on the separating plate is opened, and the buffering medium enters the outer buffering cavity 23 from the communication hole 24. In the outer buffering cavity 23, as the buffering medium flows in and impacts, the outer buffering cavity is further squeezed to drive the outer buffering cavity to expand, so as to further absorb the buffer impact energy.

For the solid-liquid mixed paraffin and paraffin that preset in the inner buffering cavity 22, when the high-speed train runs normally, the solid paraffin can prevent the leakage of the buffering medium in the cavity to a certain extent, and after the impact occurs, the instantaneous high-speed impact can generate large heat, and the collision heat generation will further convert the solid paraffin into liquid paraffin oil for oil pressure to drive the cavity to expand and deform to absorb energy. Obviously, it can also be filled with solid paraffin alone or liquid paraffin oil alone.

It should be noted that, due to the non-recoverable deformation and the one-way valve 25 arranged between the inner buffering cavity 22 and the outer buffering cavity 23, the paraffin oil entering the outer buffering cavity 23 does not return into the inner buffering cavity 22, and therefore, the anti-collision buffering device for high-speed train 100 has a service life. After a certain number of times, the replacement needs to be performed. The specific usage times are different according to different traveling routes and driving mileage of the train, but the anti-collision buffering device for high-speed train is simple in structure and low in manufacturing cost, and does not increase the driving cost of the high-speed train.

Figure 4:
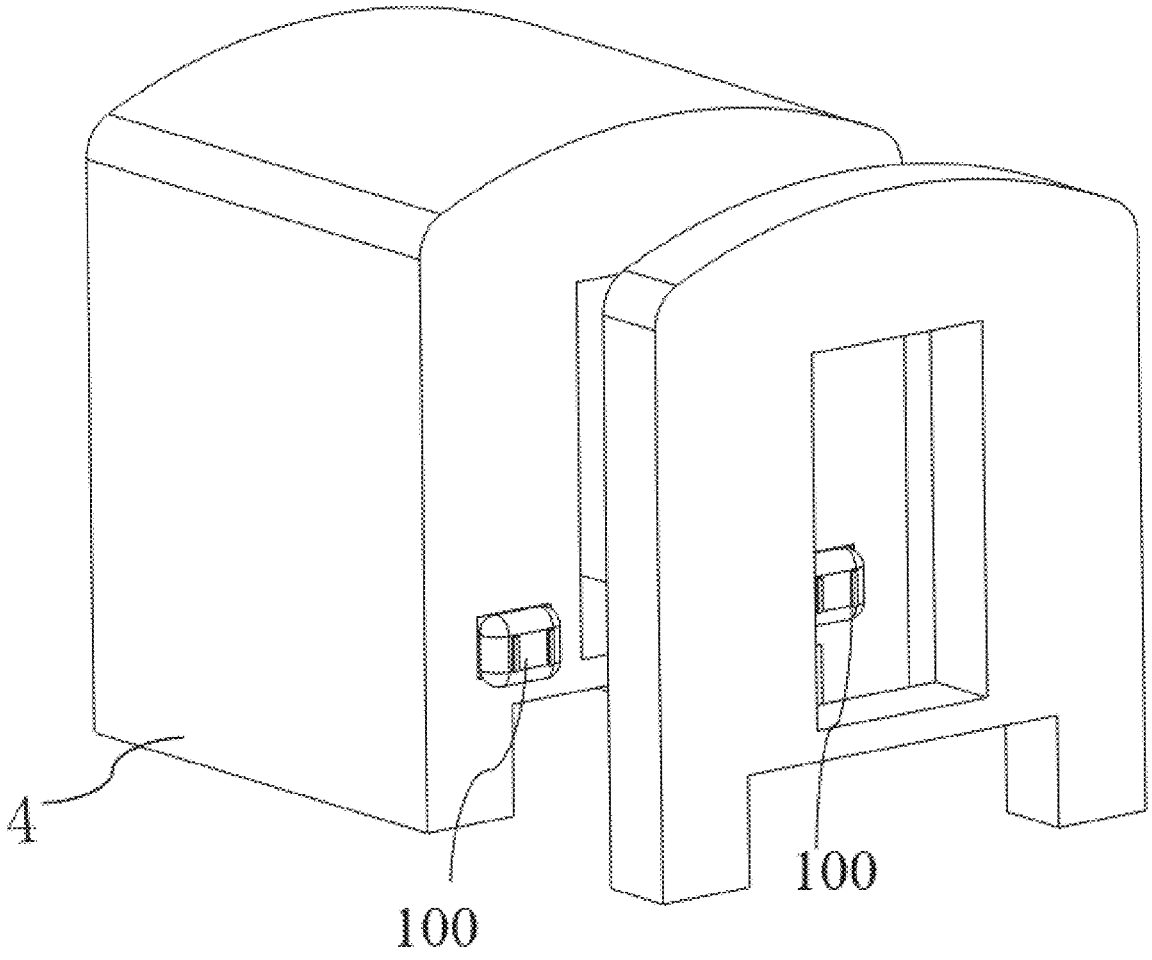
FIG. 4 is a schematic structural diagram of anti-collision buffering device for high-speed trains are mounted on a rear compartment tail plate according to an embodiment of the present disclosure

Please refers to FIG. 4, the number of anti-collision buffering device for high-speed train 100 arranged between the front carriage and the rear carriage needs to be symmetrically arranged with the center line of the width of the carriage, and when the singular is set, one anti-collision buffering device for high-speed train 100 is placed in the middle of the carriage; and when a plurality of the anti-collision buffering device for high-speed trains are set, the symmetrical arrangement can be achieved. The setting method is also applicable to the setting of different numbers of the contacting beams 3 at a bottom of the impacting and buffering body 2.

The specific structure of the follow focus controller may refer to the foregoing embodiments. The follow focus system adopts all the technical solutions of the foregoing embodiments, so it at least has all the technical effects brought by the technical solutions of the foregoing embodiments, which is not detailed herein.

The above are only some embodiments of the present disclosure, and neither the words nor the drawings can limit the protection scope of the present disclosure. Any equivalent structural transformation made by using the contents of the specification and the drawings of the present disclosure under the overall concept of the present disclosure, or directly/indirectly applied in other related technical fields are included in the protection scope of the present disclosure.

What is claimed is:

1. An anti-collision buffering device for high-speed train, wherein, comprising an impacting and buffering body, wherein the impacting and buffering body is hollow to form a buffering cavity, and the buffering cavity is filled with buffering medium; and a contacting pad is arranged at a front end of the impacting and buffering body, wherein the contacting pad is made of a whole steel plate, and the contacting pad is configured to fixedly connect with a front compartment tail plate of a high-speed train; and contacting beams are arranged at a rear end of the impacting and buffering body, wherein the contact beams are arranged in pairs and are symmetrical to a center line of the impacting and buffering body, and the contact beams are configured to fixedly connect with a rear compartment tail plate of the high-speed train; and one or more impacting and buffering bodies are arranged between two adjacent carriages of the high speed train, and are symmetrically arranged along a width center line of the carriage;

the buffering cavity is divided into three sub-cavities by separating plates, an inner buffering cavity at a middle and two outer buffering cavities at sides, wherein the two outer buffering cavities are located on a left side and a right side of the inner buffering cavity respectively, and the inner buffering cavity is communicated with the two outer buffering cavities through communication hole; and a protruding cavity is arranged on the inner buffering cavity, wherein the protruding cavity is convex upwards at a top of the inner buffering cavity, and the protruding cavity are completely communicated with the inner buffering cavity.

2. The anti-collision buffering device for high-speed train according to claim 1, wherein a one-way valve is arranged in the communication hole between the inner buffering cavity and the outer buffering cavity.

3. The anti-collision buffering device for high-speed train according to claim 2, wherein a thickness of the contacting pad is 15 mm to 25 mm.

4. The anti-collision buffering device for high-speed train according to claim 1, wherein a top of the contacting beam is designed in an arc-shaped structure, and a distance of a top width is less than that of a bottom width.

5. The anti-collision buffering device for high-speed train according to claim 3, wherein the impacting and buffering body has a flat structure with a height between 150 mm to 250 mm, and a length and a width of the impacting and buffering body are both greater than a height of the impacting and buffering body.

6. The anti-collision buffering device for high-speed train according to claim 5, wherein the inner buffering cavity is filled with paraffin and paraffin oil in a solid-liquid mixed state.

7. The anti-collision buffering device for high-speed train according to claim 6, wherein the separating plates is provided with rounded corners, and connecting portions of the separating plates and an inner wall of the buffering cavity are processed by locally increasing a wall thickness.

8. The anti-collision buffering device for high-speed train according to claim 7, wherein an outer surface of the impacting and buffering body is coated with a polyurea coating.

9. The anti-collision buffering device for high-speed train according to claim 8, wherein a distance between two adjacent contact beams is 140 mm to 180 mm.

* * * * *